US010759568B2

(12) United States Patent
Amigoni et al.

(10) Patent No.: US 10,759,568 B2
(45) Date of Patent: Sep. 1, 2020

(54) FLEXIBLE PACKAGING OF THE BAG TYPE WITH RECLOSING DEVICE

(71) Applicant: Barilla G. e R. Fratelli S.p.A., Parma (IT)

(72) Inventors: Michele Amigoni, Salsomaggiore Terme (IT); Ivano Lodi Rizzini, Parma (IT); Laurette Defranco, Parma (IT); Andrea Bordini Santucci, Parma (IT)

(73) Assignee: Barilla G. e R. Fratelli S.p.A., Parma (IT)

( * ) Notice: Subject to any disclaimer, the term of this patent is extended or adjusted under 35 U.S.C. 154(b) by 0 days.

(21) Appl. No.: 16/186,754

(22) Filed: Nov. 12, 2018

(65) Prior Publication Data

US 2019/0144167 A1 May 16, 2019

(30) Foreign Application Priority Data

Nov. 15, 2017 (IT) ..... 102017000130665

(51) Int. Cl.
*B65D 33/00* (2006.01)
*B65D 33/24* (2006.01)
(Continued)

(52) U.S. Cl.
CPC ..... *B65D 33/24* (2013.01); *B65D 31/10* (2013.01); *B65D 33/1691* (2013.01);
(Continued)

(58) Field of Classification Search
CPC .... B65D 33/24; B65D 33/1691; B65D 31/10; B65D 77/14; B65D 2101/0007; B65D 2313/00
(Continued)

(56) References Cited

U.S. PATENT DOCUMENTS 6,047,883 A * 4/2000 Calvert ..... B65D 5/061 229/123.3
6,773,163 B2 * 8/2004 Ichikawa ..... B29C 45/14336 383/204
(Continued)

FOREIGN PATENT DOCUMENTS

EP 0 677 832 A1 10/1995

OTHER PUBLICATIONS

European Search Report issued in connection with corresponding European Patent Application No. 18 20 4896.
(Continued)

*Primary Examiner* — Peter N Helvey
(74) *Attorney, Agent, or Firm* — Akerman LLP

(57) ABSTRACT

Flexible packaging (1) of the bag type for loosely packaged perishable food products, comprising: a front wall (2) and a rear wall (3) situated opposite each other, defining on the upper part a closing fin (4) and laterally connected together by two gusset walls (5); and a reclosing device comprising a first planar portion (12) and a second planar portion (13) fixed to the front wall (2) and to the rear wall (3) respectively and equipped with means (7; 8) for mutual connection in an overlapped configuration; wherein, in a shelf configuration, said package (1) has the closing fin (4) folded over on top of said rear wall (3), the first planar portion (12) and the second planar portion (13) of the reclosing device being arranged side-by-side and integrated in a planar insert (10) which can be broken along a separation line (1) between said first portion (12) and said second portion (13).

14 Claims, 5 Drawing Sheets

(51) Int. Cl.
*B65D 30/20* (2006.01)
*B65D 33/16* (2006.01)
*B65D 77/14* (2006.01)

(52) U.S. Cl.
CPC ..... *B65D 77/14* (2013.01); *B65D 2101/0007* (2013.01); *B65D 2313/00* (2013.01)

(58) Field of Classification Search
USPC ..... 383/203
See application file for complete search history.

(56) References Cited

U.S. PATENT DOCUMENTS

| | | | | |
|---|---|---|---|---|
| 8,641,279 | B2 * | 2/2014 | Ichikawa | B65D 33/2533 383/204 |
| 9,315,297 | B2 * | 4/2016 | Jonsson | B65D 33/1691 |
| 10,562,689 | B2 * | 2/2020 | Bazbaz | B65D 31/10 |
| 2004/0008908 | A1 * | 1/2004 | Shepard | B65D 33/24 383/89 |
| 2004/0223665 | A1 * | 11/2004 | Blohowiak | B65D 33/24 383/89 |
| 2007/0079481 | A1 | 4/2007 | Gallant | |
| 2007/0104397 | A1 * | 5/2007 | Walker | B65D 33/2591 383/203 |
| 2008/0056622 | A1 | 3/2008 | Austreng et al. | |
| 2012/0052161 | A1 | 3/2012 | Woodham | |

OTHER PUBLICATIONS

Italian Search Report issued in connection with corresponding Italian Patent Application No. 102017000130665.

* cited by examiner

FLEXIBLE PACKAGING OF THE BAG TYPE WITH RECLOSING DEVICE

CROSS-REFERENCE TO RELATED APPLICATIONS

The present application claims priority to Italian Patent Application No. 102017000130665, filed Nov. 15, 2017, the entirety of which is incorporated herein by reference.

FIELD OF APPLICATION

The present invention relates, according to its more general aspect, to a flexible packaging of the bag type, in particular but not exclusively suitable for perishable food products, such as oven-baked products, in particular biscuits and the like.

The invention may therefore have a useful application in the packaging sector, in particular in the food packaging sector.

PRIOR ART

It is known that one of the main requirements in the sector for the production and distribution of perishable foods is that of providing a packaging which is able to maximize the shelf life, namely prolong the period during which conservation of the original organoleptic properties of the packaged foods may be reasonably ensured.

For this purpose, suitable paper or plastic materials for manufacture of the packaging, along with suitably shaped containers and suitable methods for sealing them once filled with the required products, have been designed, tested and made available.

With regard to oven-baked food products, such as shortbread biscuits and the like, which are generally packaged loose in bag-type packages and which are eaten gradually over time, along with the aforementioned requirement there is also the problem of ensuring a certain degree of protection for the product which remains following opening of the packaging.

For this purpose, bag-type packages provided with structural devices or systems designed to allow temporary reclosing of the said package, following peeling, tearing or cutting of the top fin necessary for accessing the products, have been designed and made available.

The main most widely used reclosing system is the self-adhesive label; it is used to fix a top part of the front and rear walls of the bag-type package which comprise the inlet mouth thereof in a condition folded over several times onto itself.

A bag-type package provided with a self-adhesive reclosing label is described, for example, in European Patent EP 0 677 832 B1 in the name of the Applicant.

However, it is known that self-adhesive labels allow efficient reclosing only a limited number of times owing to the rapid deterioration of their adhesive properties and the fact that they are used in the presence of grease, crumbs and other contaminating agents.

Among the various alternative reclosing systems which have been proposed in the prior art, none of them has proved to be a commercially viable alternative to the self-adhesive label for bag-type packages of the type considered in the present invention. These alternative systems in fact have various drawbacks which today remain unsolved, such as a relatively high production cost, a system which is not easy to use and, in some cases, a closing efficiency which is in any case limited over time.

SUMMARY OF THE INVENTION

The problem underlying the present invention is that of providing a flexible package of the bag type provided with a reclosing device which overcomes, in a simple and low-cost manner, all the drawbacks mentioned with respect to the prior art: in particular a bag in which the reclosing device guarantees always, i.e. on an indefinite number of occasions, the same efficient reclosing action, while ensuring low production costs.

This problem is solved, according to the invention, by a flexible packaging of the bag type for loosely packaged perishable food products, comprising: a front wall and a rear wall situated opposite each other, defining on the upper part a closing fin and laterally connected together by two gusset walls; and a reclosing device comprising a first planar portion and a second planar portion fixed to the front wall and to the rear wall respectively and equipped with means for mutual connection in at least one overlapped configuration; wherein, in a shelf configuration, said package has the closing fin folded over, along a main folding axis, on top of said rear wall, the first planar portion and the second planar portion of the reclosing device being arranged side-by-side and integrated in a planar insert which can be broken along a separation line between said first portion and said second portion.

As a person skilled in the art will be able to understand, the configuration proposed above advantageously allows the use of a connection, preferably of the mechanical type, comprising two oppositely arranged portions, without however having to produce and fix separately the two portions which define the said connection.

The aforementioned closing fin, which in the shelf configuration is sealed, preferably by means of heat-sealing, may be conveniently unsealed, or else cut, by the user so as to define an access mouth for access to the product.

In order to close the package again, the user may than fold over the fin twice, along axes parallel to the main folding axis, on top of said rear wall, so as to close said access mouth and arrange said first and second planar portions in an overlapped configuration in which the mutual connection means form a releasable connection.

Preferably, in order to allow the unitary construction of the planar insert and overlapping of the first and second planar portions after performing the two aforementioned folds, the first planar portion is fixed to the front wall along the upper edge of the closing fin, or adjacent thereto, whereas the second planar portion is fixed to the rear wall in a position spaced from—preferably at a distance equal to twice the extension of the fold of the top fin in the shelf configuration—the upper edge of the closing fin.

The aforementioned separation line is preferably a weakening line which facilitates the mutual detachment of the first and second planar portions by the user.

The planar insert may be made of different materials, for example rigid cardboard, cellulose fiber pulp or a plastic such as polypropylene.

In the case of rigid cardboard, the separation/weakening line may be conveniently formed as a partially pre-cut line, or two partially pre-cut parallel lines, for example with a conventional herringbone configuration.

In the case of a plastic or cellulose fiber insert, the first planar portion and the second planar portion may be connected together, along the separation/weakening line, by a plurality of breakable bridges.

Preferably, the mutual connection means are mechanical interlocking means and counter-means, which are raised and inset respectively, or vice versa, with respect to a connection surface of the first planar portion and second planar portion respectively.

In particular, said mechanical interlocking means may be formed as one or more buttons and said mechanical interlocking counter-means are formed as one or more holes adapted to received said buttons with an interference fit.

Preferably, both the buttons and the holes will consist of a plurality arranged linearly along an axis parallel to the main folding axis. The same also applies to mechanical interlocking means and counter-means which are an alternative to pairs of buttons/holes.

Other embodiments are obviously possible for the connection means: for example, it is possible to consider using other interlocking or engaging systems, for example a snap-engaging system or also Velcro® or totally or partially adhesive connection surfaces.

Preferably, the mutual connection means may have a plurality of different connecting configurations, corresponding to a plurality of positions of the first planar portion with respect to the rear wall, said positions being spaced from each other along a direction perpendicular to the main folding axis.

For example, in the aforementioned case of buttons and holes, a plurality of successive rows may be provided for the element arranged on the rear wall so as to be able to engage the other element with any one of these rows. The same also applies to mechanical interlocking means and counter-means which are an alternative to pairs of buttons/holes.

The aforementioned plurality of connecting configurations allows the closure to be adapted to the filling level of the package, so that the package is compressed more as the product is gradually used and the package consequently becomes emptier.

In some variants of the package according to the present invention, one of the said first planar portion and second planar portion comprises at least one engaging sub-portion, which is at least partially fixed to the underlying front wall or rear wall, while the other planar portion comprises at least one window which is open on the underlying front wall or rear wall. The at least one engaging sub-portion and the at least one window define here the mutual connection means. Advantageously the planar portion which has the engaging portion also comprises a removable sub-portion, which is not directly fixed to the underlying front wall or rear wall and is separated from the engaging sub-portion(s) by a separation profile. The removal of this removable sub-portion releases the engaging sub-portion(s), leaving it/them raised with respect to the underlying front or rear wall.

In these variants, which are preferably made of cardboard, the male element of the connection means—namely the engaging sub-portion—forms advantageously part of a planar portion with a uniform thickness; owing to the operation of removal of the removable sub-portion, which connects in the shelf configuration the engaging sub-portion to the other planar portion comprising the oppositely arranged window, the element assumes a raised condition, allowing it to be used.

In these variants, the at least one engaging sub-portion may engage with the at least window by means of a simple form-fitting connection due to engagement by means of interference.

As an alternative to or in combination with this form-fitting connection a flap-like connection may be provided. In this case, the engaging sub-portion has at least one flap which is free with respect to the underlying front or rear wall and is adapted to be inserted into a corresponding slot defined by a planar portion area not fixed to the underlying front wall or rear wall along an edge of the respective window.

It is pointed out that the walls of the flexible package according to the present invention are preferably made of cardboard, but obviously the use of another material—for example plastic—is also possible provided that it has the flexibility needed to fold over the packaging during operation of the reclosing device described above.

The advantages and characteristic features of the flexible package according to the present invention will emerge more clearly from the description of an example of embodiment thereof provided hereinbelow with reference to the attached drawings provided by way of a non-limiting example.

DETAILED DESCRIPTION OF A PREFERRED EMBODIMENT

Figure 2:
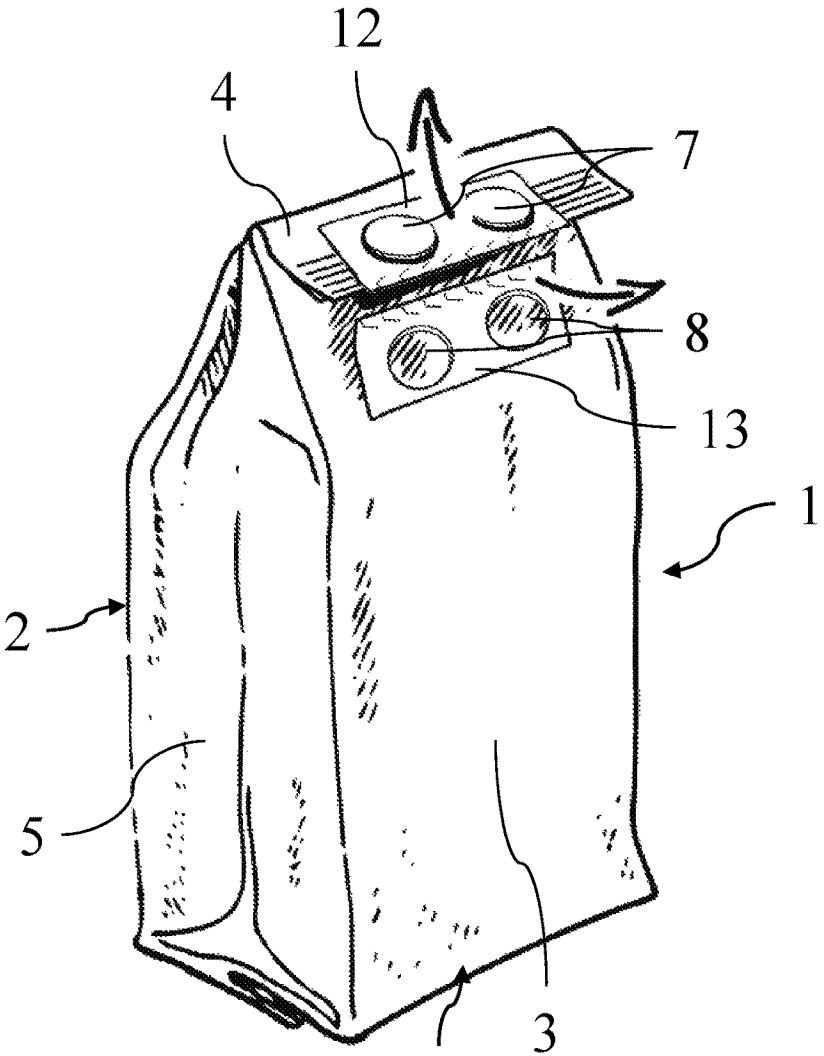
FIG. 2 shows in schematic form a first step of the process for opening the bag-type package according to FIG. 1.

With reference to the attached FIGS. 1-6, 1 denotes overall a flexible package of the bag type for perishable food products, in particular for oven-baked products such as shortbread biscuits and the like, which are packaged loosely.

The position references used in the present description, comprising indications such as "front" or "rear", "in front of" or "behind", "upper" or "lower", "above" or "below", "laterally" or similar references, in all cases refer to the illustrative configuration shown in the aforementioned figures and must not in any case be attributed any restrictive value.

With reference to the expressions "front" or "rear" it is pointed out that these are used mainly for the sake of easier description and, although they suggest a preferred orientation of the package on the shelf of the distribution outlet, they must not be regarded as having a limiting meaning. In particular, it is possible for the side described here as "rear" to be printed or otherwise decorated with brand markings and/or pictures of the product such that it may be placed on display so as to face the consumers.

The flexible package 1, which is referred to below simply as "package", has a substantially parallelepiped form with a front wall 2 and rear wall 3, which are situated opposite to each other and are the same, and gusset walls 5 which laterally connect said front and rear walls. The front wall 2 and rear wall 3 are joined together at the top in the form of a closing fin 4 where the two top edge zones of these walls are heat-sealed or in any case sealed using a suitable technique. At the bottom, the package 1 has a support base 14 which may be defined by a bottom fin which is suitably folded over or in any other way known to the person skilled in the art.

Preferably, the walls 2, 3, 5 and the support base 14 are all made of paper-like material, i.e. paper, cardboard or other material which can be recycled together with paper. Alternatively, other materials, for example plastic materials, may be used, provided obviously that they do not adversely affect the flexibility of the walls where required for the reclosing operations described below.

The aforementioned closing fin 4, in a manner known per se, may be unsealed or in any case torn along the seal, so as to define an access mouth 9 for access to the products—in the preferred example oven-baked products such as biscuits—contained inside the package 1.

The package 1 also comprises a device for reclosing the aforementioned access mouth 9, which may be used by the end user to close said mouth following initial opening of the package 1.

This reclosing device is composed of a first planar portion 12 and a second planar portion 13 which are respectively fixed—by means of gluing or another system suitable for the prechosen material—to the front wall 2 and to the rear wall 3 of the package 1. For reasons which will become clearer from the following description, the first planar portion 12 is fixed close to the upper rim of the front wall 2—namely onto the outer edge zone of the access mouth 9—while the second planar portion is fixed spaced from the upper rim of the respective rear wall 3. As regards instead the position along the horizontal axis, both the planar portions 12, 13 are arranged in a middle position, namely at the same distance from the two lateral gusset walls 5.

The two planar portions 12, 13 in the preferred embodiment described below have the form of rectangular tabs of the same size, which adhere for the most part to the underlying front wall 2 or rear wall 3. The first planar portion 12 has a plurality of raised circular buttons 7 which are arranged in horizontal sequence on the exposed surface. The second planar portion 13 has a corresponding number of circular holes 8; said holes 8 are formed blind owing to the presence, underneath, of the respective rear wall 3 and are also arranged in horizontal sequence with the same interaxial spacing. The buttons 7 are designed to engage with an interference fit inside the holes 8 so as to releasably fix the first planar portion 12 to the second planar portion 13. In the embodiment described here the number of buttons 7 and holes 8 is two in each case.

The connection described above may obviously have numerous variants which may be easily envisaged by the person skilled in the art, for example in terms of the number, arrangement and shape of the buttons 7 and holes 8. A connection of a different type may also be envisaged whereby it is ensured that the exposed surfaces of the two planar portions 12, 13, when superimposed, may be connected together in a provisional manner.

Figure 1:
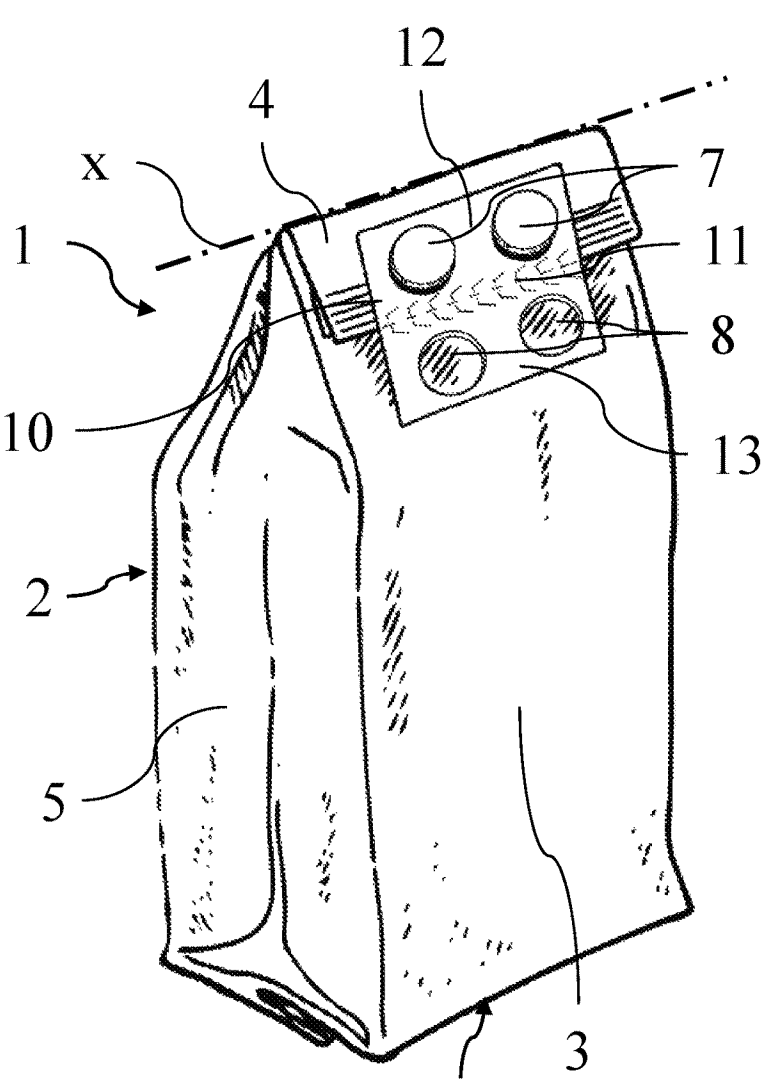
FIG. 1 shows in schematic form a perspective view of a bag-type package according to the present invention in a shelf configuration.

In a shelf configuration, namely in the configuration following packaging and before opening by the end user, the package 1 has the form as shown in FIG. 1.

In this configuration, the closing fin 4—the upper seal of which is still intact—is folded over along a main folding axis "x" and is mounted so as to adhere to the rear wall 3. The first planar portion 12, which is fixed to the upper folded-over edge zone of the front wall 2, and the second planar portion 13, which is fixed to the rear wall 3 immediately below this folded-over edge zone, are combined in a single planar insert 10 which is designed to be divided along a middle separation line 11. The planar insert 10 is therefore fixed straddling the folded-over portion of the front wall 12 and the underlying rear wall 3, therefore fixing the closing fin 4 in a folded-over position.

The aforementioned planar insert 10, in the embodiment shown here, is made of rigid cardboard or a similar paper-like material. The separation line 11 is suitably weakened by means of the formation of pre-cut herringbone pattern. Two patterns, instead of one, could be arranged in two parallel rows.

Alternatively, the planar insert 10 may be made by means of injection-molding of thermoplastic material, for example polypropylene, or recyclable material such as cellulose fiber pulp. In place of injection-molding it is obviously possible to used other known methods such as thermoforming. In a manner known per se, the two planar portions 12, 13 may be connected together along the separation line 11 by breakable bridge-pieces, which may be formed during the course of the aforementioned injection-molding or thermoforming process.

The operating principle of the package 1 with reclosing device according to the invention is already clear to the reader and is described in detail below, with particular reference to FIGS. 2-6.

FIG. 2 shows a first step during opening of the package by the end user. During this step, the user tears, cuts or in any case divides the planar insert 10 along the separation line 11, separating the first planar portion 12 from the second planar portion 13. Then, once this fastening has been released, the user lifts the folded-over edge zone so as to arrange the closing fin 4 in a raised position.

Figure 3:
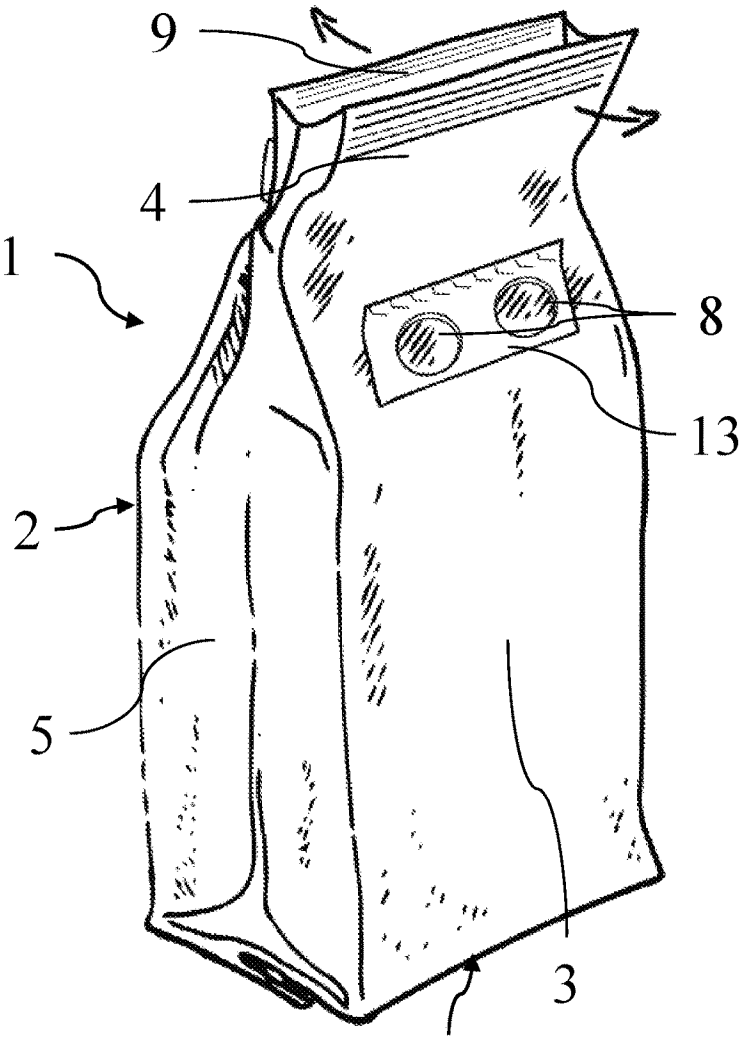
FIG. 3 shows in schematic form a second step of the process for opening the bag-type package according to FIG. 1.

FIG. 3 shows a following step during which the closing fin 4 is unsealed in order to open the access mouth 9 and allow the user to reach the product. The configuration thus obtained is the open configuration of the package 1.

Figure 4:
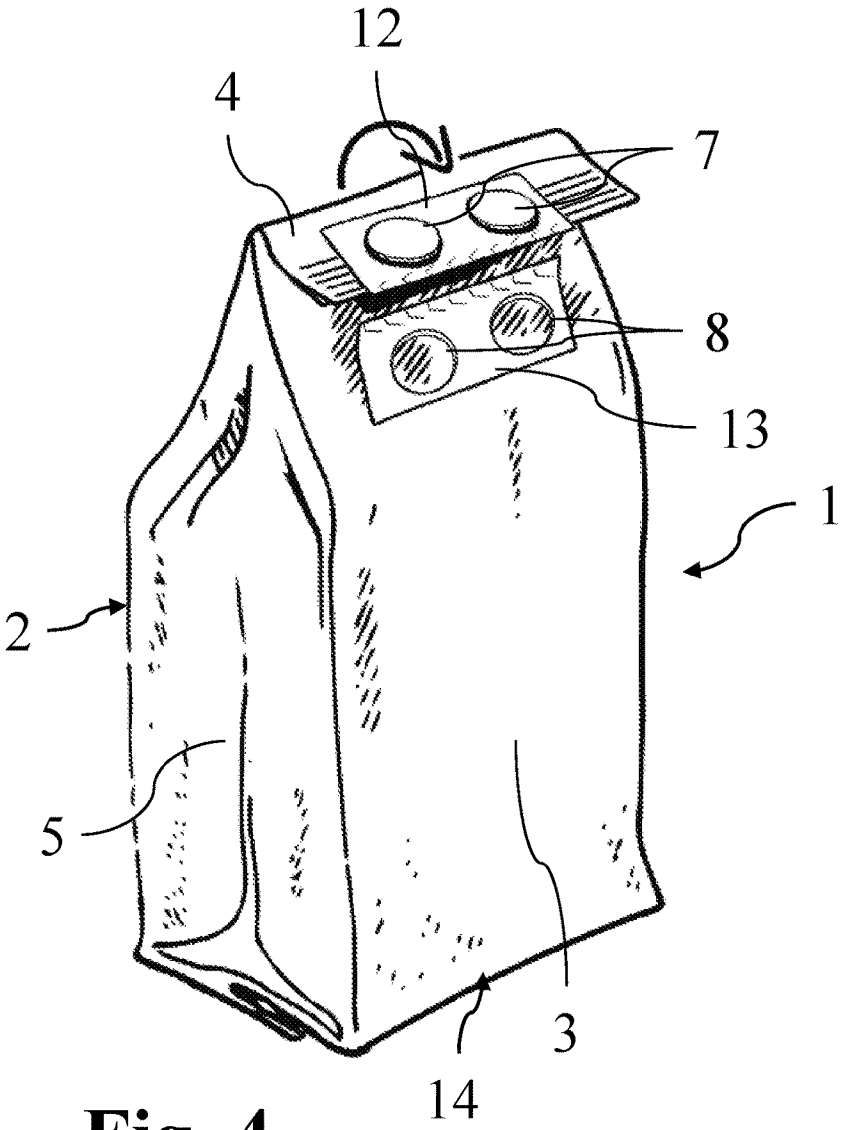
FIG. 4 shows in schematic form a first step of the process for reclosing the bag-type package according to FIG. 1.

FIG. 4 shows a first step of the reclosing process, in which the closing fin 4 is folded over again along the main folding line "x" indicated above, so as to close the access mouth 9.

Figure 5:
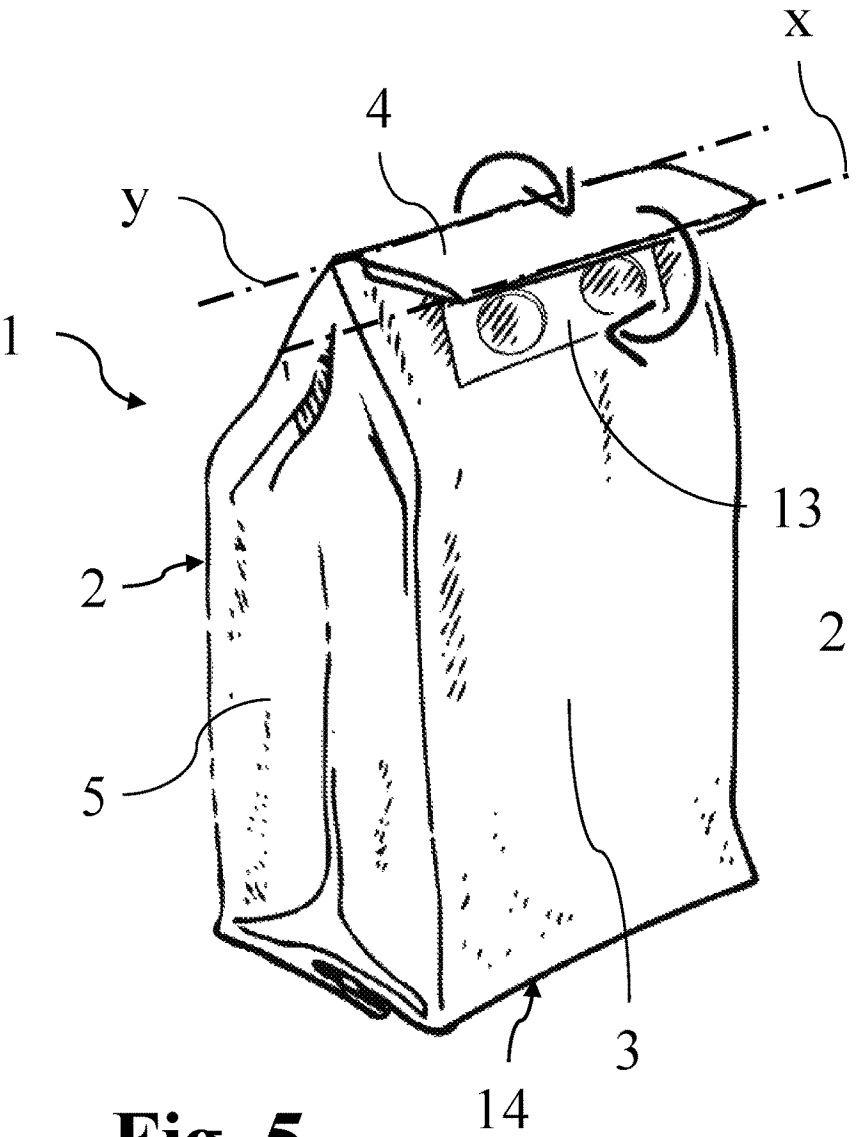
FIG. 5 shows in schematic form a second step of the process for reclosing the bag-type package according to FIG. 1.

FIG. 5 shows a second step of the reclosing process, during which the closing fin 4 is folded over a second time along a secondary folding axis "y" parallel to the aforementioned main folding axis "x", so that the exposed faces of the first planar portion 12 and the second planar portion 13 are brought into contact with each other.

Figure 6:
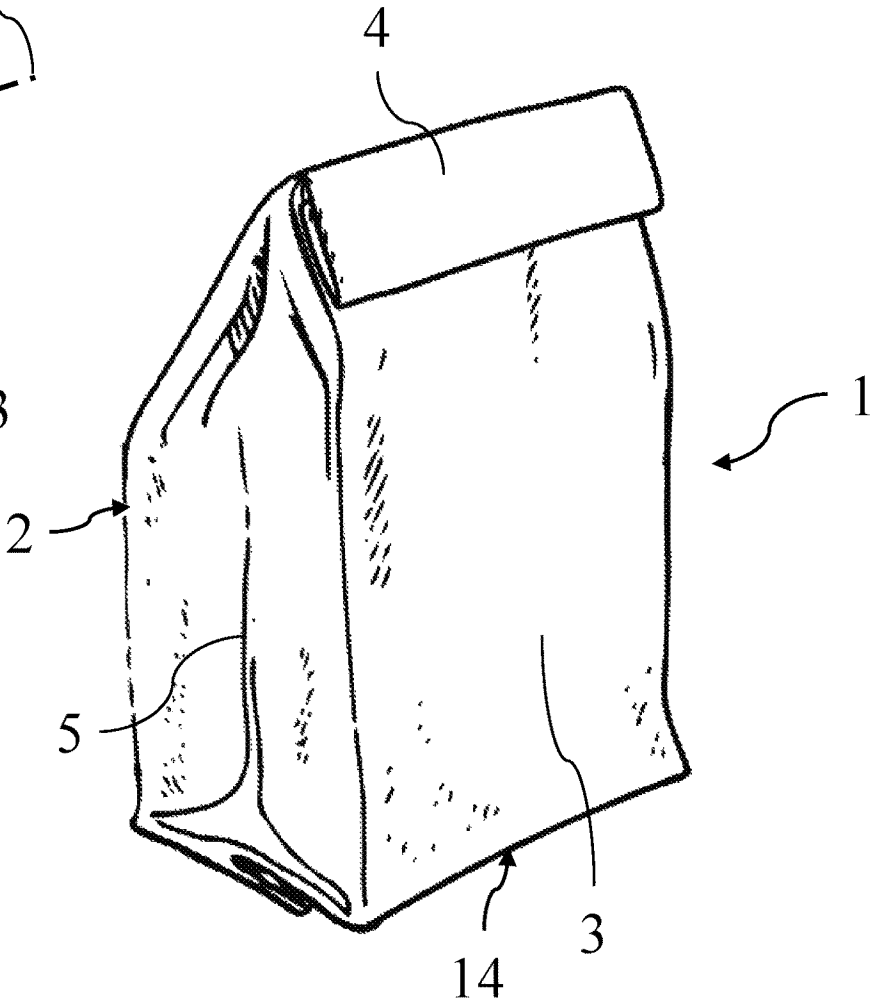
FIG. 6 shows in schematic form the bag-type package according to FIG. 1 in a reclosed configuration.

In the third and final step of the folding-over process, the two planar portions 12 and 13 are releasably connected together by introducing the buttons 7 inside the respective holes 8. The reclosing configuration thus obtained is shown in FIG. 6.

From this reclosing configuration it is obviously possible to obtain the open configuration of the package 1 by separating the planar portions 12, 13 and unfolding the closing fin 4 so as to release the access mouth 9.

Figure 7B:
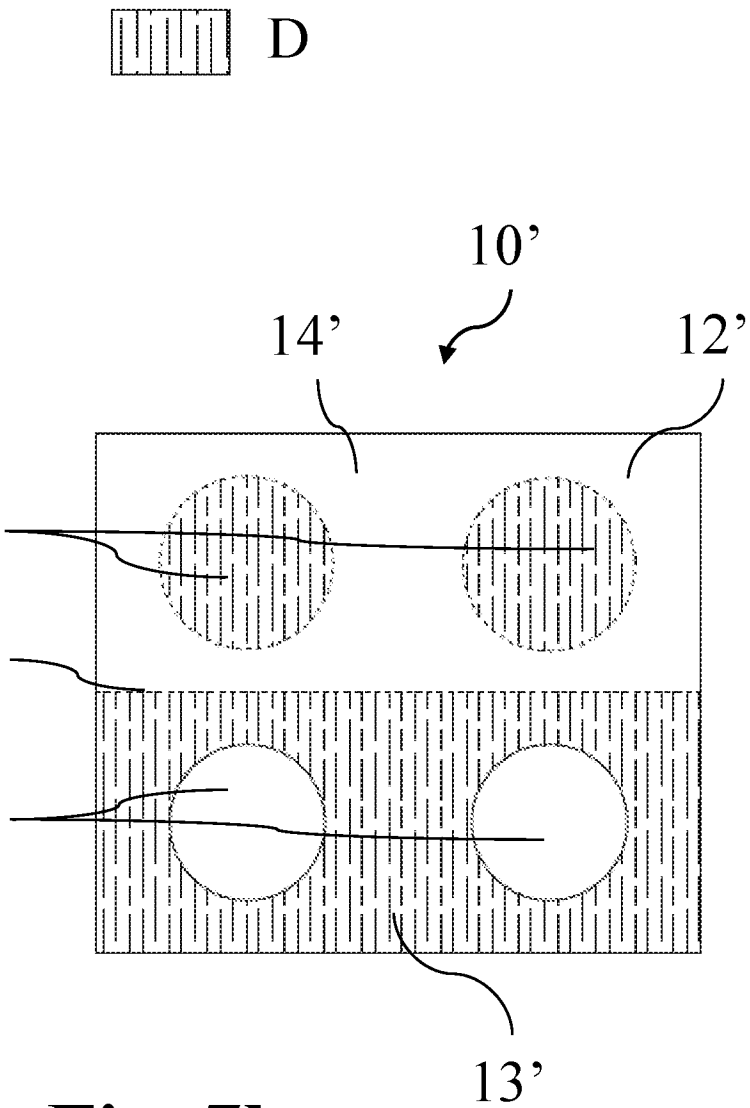
FIG. 7*b* shows a gluing diagram of the planar insert according to FIG. 7*a*, where the hatched pattern D indicates the areas to be glued.
Figure 7A:
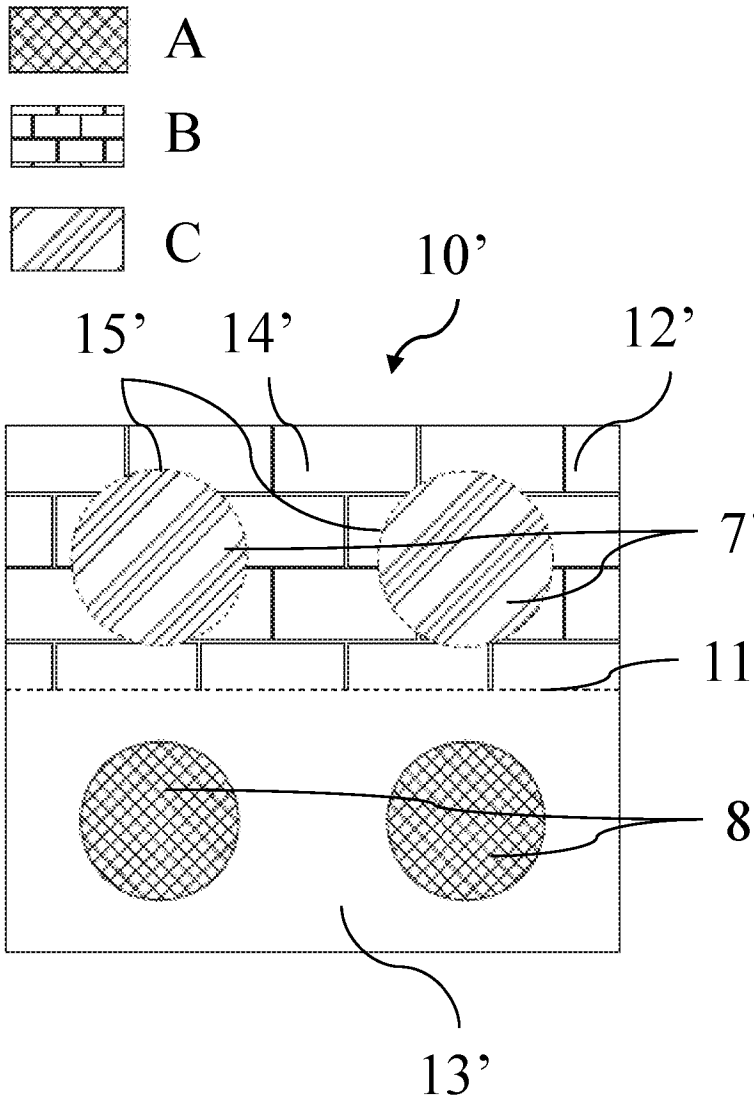
FIG. 7*a* shows a first variant for the planar insert used in the packages according to the present invention, where the broken lines indicate pre-cut lines, a hatched pattern A indicates a sub-portion which is removed to define a window, a hatched pattern B indicates a sub-portion which can be removed by the user and a hatched pattern C indicates a raised engaging sub-portion.

With reference to the attached FIGS. 7*a*, 7*b*, a first variant 10' of the above-described planar insert 10 which may be associated with a package 1 according to the invention is now described. In the description of this variant, elements and parts of elements described above are indicated using the same reference numbers followed by an apostrophe.

The planar insert 10' according to the first variant has a uniform thickness and may be conveniently made from a sheet of rigid cardboard or other material suitable for the purpose which is pre-cut as indicated by the broken lines in FIG. 7*a* and glued to the package 1 as indicated by the hatched pattern D shown in FIG. 7*b*.

The first portion 12' of the planar insert 10' consists in this case of two sub-portions: an engaging sub-portion 7', which is defined in the case in question by two cylindrical buttons and glued directly onto the underlying front wall 2; and a removable sub-portion 14' which is instead not glued to the package 1.

The second portion 13' has instead two circular windows 8' which are shaped to match the aforementioned cylindrical buttons and which are formed in the underlying rear wall 3.

The removable sub-portion 14' is joined together with the second portion 13' along the separation line 11'. As in the preceding embodiment, in the shelf configuration this line is arranged in a zone straddling the front wall 2 and the rear wall 3; in particular, the first planar portion 12' is fixed close to the upper rim of the front wall 2, while the second planar portion 13' is fixed spaced from the upper rim of the respective rear wall 3. Moreover, the removable sub-portion 14' is connected to the engaging sub-portion 7' by means of a separation profile 15' which is also defined, like the separation line 11', by a pre-cut line.

At the time of opening of the package 1, the user may thus separate, as in the preceding embodiment, the first portion 12' from the second portion 13' along the separation line 11'; then the user may completely detach the removable sub-portion 15' from the engaging sub-portion 7' so as to isolate the two buttons and leave them raised with respect to the underlying front wall 2.

At this point, by means of folding operations similar to those described above for the first embodiment, the user may insert the two raised buttons 7' into the corresponding windows or holes 8', where they are received with an interference fit, thereby defining the releasable connection.

It should be noted that, in connection with the present variant, the form of the engaging sub-portion(s) 7' and the window(s) 8' may be different, while maintaining the convenient solution of using, in an insert of uniform thickness, a removable sub-portion 15' able to free in the reclosing configuration a first element raised with respect to a wall of the package.

Figures 8A, 8B:
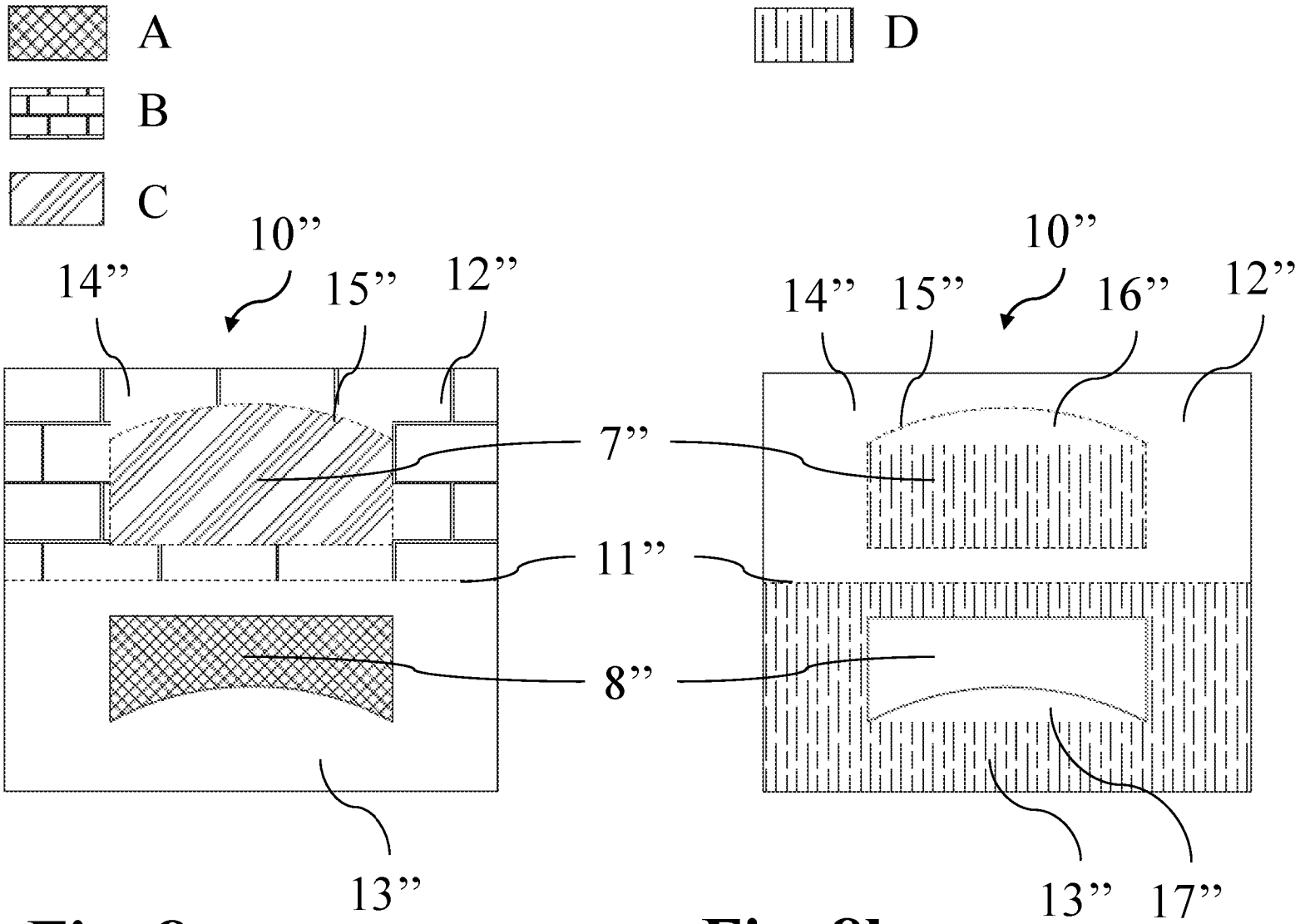
FIG. 8*a* shows a second variant for the planar insert used in the packages according to the present invention, where the broken lines indicate pre-cut lines, a hatched pattern A indicates a sub-portion which is removed to define a window, a hatched pattern B indicates a sub-portion which can be removed by the user and a hatched pattern C indicates a raised engaging sub-portion.
FIG. 8*b* shows a gluing diagram of the planar insert according to FIG. 8*a*, where the hatched pattern D indicates the areas to be glued.

With reference to the attached FIGS. 8*a*, 8*b*, a second variant 10" of the above-described planar insert 10 which may be associated with a package 1 according to the invention is now described. In the description of this variant, elements and parts of elements described above are indicated using the same reference numbers followed by a double apostrophe.

The planar insert 10" according to the second variant is similar to that of the first variant: it has in fact a uniform thickness and may be conveniently made from a sheet of rigid cardboard or other material suitable for the purpose, pre-cut as indicated by the broken lines in FIG. 8*a* and glued to the package 1 as indicated by the hatched pattern D shown in FIG. 8*b*.

The first portion 12" of the planar insert 10" consists in this case also of two sub-portions: an engaging sub-portion 7", which is defined in the case in question by a parallelepiped with one of its long sides convex, glued directly onto the underlying front wall 2; and a removable sub-portion 14" which is instead not glued to the package 1.

The second portion 13" instead has a window 8" which is formed in the underlying rear wall 3 as a parallelepiped with one of its long sides concave.

The removable sub-portion 14" is joined together with the second portion 13'" along the separation line 11". As in the preceding embodiments, in the shelf configuration this line is arranged in a zone straddling the front wall 2 and the rear wall 3; in particular, the first planar portion 12" is fixed close to the upper rim of the front wall 2, while the second planar portion 13" is fixed spaced from the upper rim of the respective rear wall 3. Moreover, the removable sub-portion 14" is also joined here to the engaging sub-portion 7" by means of a separation profile 15" which also is defined by a pre-cut line.

Differently from that envisaged in the first variant described above, in this second variant the engaging sub-portion 7" and the second portion 13" are not uniformly glued onto the respective walls of the package 1. As can be seen in fact from the gluing diagram shown in FIG. 8*b*, the engaging sub-portion 7" has a free flap 16" which is not glued and which in the case in question is represented by the convex curvature of the parallelepiped profile; the second portion 13" is instead not glued underneath the curvature which defines the concavity of the window 8", so as to define, between itself and the underlying rear wall 3, a slot 17".

At the time of opening of the package 1, the user may thus separate, as in the preceding embodiment, the first portion 12" from the second portion 13" along the separation line 11"; then, the user may completely detach the removable sub-portion 15" from the engaging sub-portion 7" so as to leave the latter raised with respect to the underlying front wall 2.

At this point, by means of folding operations similar to those already described for the other embodiments, the user may insert the engaging sub-portion 7" inside the window 8", thus inserting the free flap 16" inside the aforementioned slot 17".

It should be noted that, in connection with the present variant, the form of the engaging sub-portion 7" and the window 8" may be different, while maintaining the convenient solution of providing a free flap of the first element which can be introduced into a slot formed along the perimeter of the second element.

According to a variation of embodiment not shown in the figures, it is possible to provide a plurality of holes 8 or windows 8' or 8", arranged in succession at different heights on the rear wall 3. The rows of holes 8 or windows 8', 8" are in this case preferably formed in a single second planar portion 13, 13', 13" which is necessarily larger than that described above. Alternatively, still in connection with the same variant, a plurality of second planar portions 13, 13', 13" which are separate, instead of a single large portion, may be used.

Owing to this convenient solution, it is possible to obtain a plurality of reclosing configurations, which may be advantageously adapted to the gradual emptying of the package 1 as the product contained inside it is used up.

Obviously a similar solution may also be realized using connection means which are different from the buttons 7 and the holes 8 or the engaging sub-portions 7', 7" and the windows 8', 8" described here: for example successive rows of incisions or teeth designed to engage with correspondingly shaped elements formed on the first planar portion 12, 12', 12" may be provided.

It should be noted that, during the packaging operations, the planar insert 10, 10', 10" which forms the reclosing device is preferably applied after formation, filling and closing of the package 1. These operations may therefore be advantageously performed using a conventional packaging line which must not be substantially modified, other than in order to integrate downstream, if required, further stations for folding the closing fin 4 and for applying the planar insert 10, 10', 10".

The main advantage achieved by the package according to the present invention is that of allowing practical, rapid and efficient reclosing of the said package, which may be repeated a significantly greater number of times than that which is possible with the prior art, while ensuring relatively low production costs.

The flexible package with reclosing device, in particular for perishable food products, described above may be subject to other variants and modifications, all of which are within the competence of the persons skilled in the art and, as such, fall within the scope of protection defined by the following claims.

The invention claimed is:

1. A flexible package of the bag type for loosely packaged perishable food products, comprising:

a front wall and a rear wall situated opposite each other, defining on the upper part a closing fin and laterally connected together by two gusset walls; and a re-closing device comprising a first planar portion and a second planar portion fixed to the front wall and to the rear wall, respectively, and equipped with mutual connection means in at least one overlapped configuration;

wherein, in a shelf configuration, said package has a seal formed at an access mouth of the closing fin and the closing fin folded over, along a main folding axis, on top of said rear wall, the first planar portion and the second planar portion of the reclosing device being arranged side-by-side and integrated in a rigid planar insert which can be broken along a separation line between said first portion and said second portion.

2. The package according to claim 1, wherein, in a reclosing configuration, said closing fin is unsealed so as to define an access mouth for access to the product and is folded over twice, along axes parallel to the main folding axis, on top of said rear wall, so as to close said access mouth, said first planar portion and said second planar portion being in an overlapped configuration in which said mutual connection means form a releasable connection.

3. The package according to claim 2, wherein said first planar portion is fixed to the front wall along the upper edge of the closing fin, whereas the second planar portion is fixed to the rear wall in a position spaced from the upper edge of the closing fin.

4. The package according to claim 1, wherein said separation line is a weakening line which facilitates the mutual detachment of the first planar portion and the second planar portion by the user.

5. The package according to claim 4, wherein said planar insert is made of rigid cardboard, the separation line being defined by a partially pre-cut line.

6. The package according to claim 4, wherein said planar insert is made of plastic material, the first planar portion and the second planar portion being connected to each other by breakable bridges.

7. The package according to claim 4, wherein said planar insert is made of cellulose fiber pulp.

8. The package according to claim 1, wherein said mutual connection means have a plurality of different connecting configurations corresponding to a plurality of positions of the first planar portion with respect to the rear wall, said positions being mutually spaced apart along a direction perpendicular to the main folding axis.

9. The package according to claim 1, wherein said mutual connection means are mechanical interlocking means and counter-means, which are raised and inset respectively, or vice versa, with respect to a connecting surface of the first planar portion and the second planar portion respectively.

10. The package according to claim 9, wherein said mechanical interlocking means are formed as one or more buttons and said mechanical interlocking counter-means are formed as one or more holes adapted to receive said buttons with an interference fit.

11. The package according to claim 1, wherein:

one of said first planar portion and said second planar portion comprises: at least one engaging sub-portion, which is at least partially fixed to the underlying front wall or rear wall; and a removable sub-portion, which is not directly fixed to the underlying front wall or rear wall and is separated from the at least one engaging sub-portion by at least one separation profile, the removal of said removable sub-portion releasing the at least one engaging sub-portion and leaving it raised with respect to the underlying front wall or rear wall;

the other one of said first planar portion and said second planar portion comprising at least one window, which is open on the underlying front wall or rear wall;

said at least one engaging sub-portion and said at least one window defining said mutual connection means.

12. The package according to claim 11, wherein said at least one engaging sub-portion has at least one free flap with respect to the underlying front wall or rear wall, which is adapted to be inserted into a corresponding slot defined by a planar portion area not fixed to the underlying front wall or rear wall along an edge of said window.

13. The package according to claim 1, wherein both the walls and the planar insert are made of paper material.

14. The package according to claim 1, wherein both the walls and the planar insert are made of plastic material.

* * * * *